US010186787B1

(12) United States Patent
Wang et al.

(10) Patent No.: US 10,186,787 B1
(45) Date of Patent: Jan. 22, 2019

(54) SLOT RADAR ANTENNA WITH GAS-FILLED WAVEGUIDE AND PCB RADIATING SLOTS

(71) Applicant: Honeywell International Inc., Morris Plains, NJ (US)

(72) Inventors: Nigel Wang, Shanghai (CN); David C. Vacanti, Renton, WA (US)

(73) Assignee: Honeywell International Inc., Morris Plains, NJ (US)

( * ) Notice: Subject to any disclaimer, the term of this patent is extended or adjusted under 35 U.S.C. 154(b) by 0 days.

(21) Appl. No.: 15/695,910

(22) Filed: Sep. 5, 2017

(51) Int. Cl.

| | |
|---|---|
| ***H01Q 1/38*** | (2006.01) |
| ***H01Q 21/00*** | (2006.01) |
| ***H01Q 13/10*** | (2006.01) |
| ***H01Q 21/06*** | (2006.01) |

(52) U.S. Cl.
CPC ..... *H01Q 21/005* (2013.01); *H01Q 1/38* (2013.01); *H01Q 13/10* (2013.01); *H01Q 21/064* (2013.01)

(58) Field of Classification Search
CPC ..... H01Q 21/00; H01Q 1/38; H01Q 13/10; H01Q 21/06
USPC ..... 343/770
See application file for complete search history.

(56) References Cited

U.S. PATENT DOCUMENTS

| | | | | |
|---|---|---|---|---|
| 5,541,612 A | 7/1996 | Josefsson | | |
| 6,081,241 A | 6/2000 | Josefsson et al. | | |
| 9,595,765 B1 | 3/2017 | Valayil | | |
| 2013/0081447 A1 | 4/2013 | Carter et al. | | |
| 2013/0194145 A1* | 8/2013 | Sano | H01Q 13/10 343/756 | |
| 2016/0056541 A1* | 2/2016 | Tageman | H01Q 13/18 343/771 | |

OTHER PUBLICATIONS

Le Sage, "3D Printed Waveguide Slot Array Antennas," IEEE Access, vol. 4, Apr. 2016, pp. 1258-1265.
U.S. Appl. No. 15/253,494, by Nigel Wang et al., filed Aug. 31, 2016.

* cited by examiner

*Primary Examiner* — Andrea Lindgren Baltzell
(74) *Attorney, Agent, or Firm* — Shumaker & Sieffert, P.A.

(57) ABSTRACT

A slot antenna with the low-cost, light weight features of an SIW antenna combined with the efficiency of a metallic antenna. The antenna of this disclosure may use printed circuit board manufacturing (PCB) processes to form the radiating portion to create slots and waveguide features with accurate dimensions and accurate positions. Like a metallic antenna, radio frequency (RF) energy passes through air in the radiating waveguides instead of a substrate, which means low insertion loss and high efficiency. Examples of the antenna of this disclosure may include a metallic coupling waveguide to carry the RF energy from the RF generating components of the radar system to the radiated branch waveguides. The metallic coupling waveguide may be configured to provide structural support to the PCB radiating portion as well as backwards compatibility to retrofit existing radar systems with the antenna assembly of this disclosure.

13 Claims, 15 Drawing Sheets

SLOT RADAR ANTENNA WITH GAS-FILLED WAVEGUIDE AND PCB RADIATING SLOTS

TECHNICAL FIELD

The disclosure relates to slot radar antennae and radio frequency waveguides.

BACKGROUND

A slot waveguide antenna is a type of antenna used for radar for high efficiency and high-power handling capability. To reach such high efficiency, a slot waveguide antenna array may be made of a metallic material, such as aluminum. A slot waveguide antenna is typically sensitive to assembly tolerances, meaning that small inaccuracies or gaps may negatively affect performance. A metallic waveguide slot antenna may require a costly manufacturing process to accurately machine the dimensions of the antenna and waveguide. A slot antenna called a substrate integrated waveguide (SIW) may be constructed of printed circuit board (PCB) material. SIW creates a waveguide within the substrate of the PCB. SIW antennae may suffer higher insertion loss than aluminum antennae, which may limit applications that could take advantage of SIW.

SUMMARY

In general, the disclosure is directed to an antenna that takes advantage of the low-cost, light weight features of an SIW antenna combined with the high efficiency of a metallic antenna. The antenna of this disclosure may use an SIW process for the radiating portion to create slots, and other waveguide features, with accurate dimensions and accurate positions on the antenna assembly. Like a metallic antenna, radio frequency (RF) energy passes through a gas, such as air, instead of a substrate, which means less insertion loss and high efficiency. The antenna of this disclosure may include a metallic coupling waveguide to carry the RF energy from the RF generating components of the radar system to the radiated branch waveguides of the antenna. The metallic coupling waveguide is accurately positioned and attached with RF techniques to reduce leakage, mismatch and insertion loss. The metallic coupling waveguide may be configured to provide backwards compatibility to retrofit existing radar systems with the antenna assembly of this disclosure.

In one example, the disclosure is directed to antenna device, the device comprising: a radiating slot plane comprising: a radiating slot array comprising a plurality of slots; a printed circuit board (PCB) comprising a first plated layer, a second plated layer, and a substrate layer, wherein each slot of the radiating slot array includes an interior surface. The interior surface of each slot extends from the first plated layer to the second plated layer through the substrate layer. The interior surface of each slot also comprises a conductive plated material, wherein the conductive plated material electrically connects the first plated layer to the second plated layer. The antenna device also includes a radiating waveguide comprising: a radio frequency (RF) conducting path, wherein the RF conducting path of the radiating waveguide comprises a gas; a third plated layer; and the second plated layer. The second plated layer and the third plated layer comprise a conductive material. The second plated layer is electrically connected to the third plated layer and is electrically connected to the first plated layer of the radiating plane and the third plated layer is electrically connected to the first plated layer of the radiating plane.

A method of forming a slot waveguide antenna, the method comprising: etching a first slot into a first plated layer of a radiating slot plane, wherein the radiating slot plane comprises a first printed circuit board (PCB). Etching a second slot in a second plated layer of the radiating slot plane, wherein the second plated layer is on the opposite side of the radiating slot plane from the first plated layer. Milling a substrate material of the radiating slot plane to form a first opening between the first slot and the second slot, wherein: a size and shape of the first opening is defined by an interior surface of the first opening, the size and shape of the first opening is approximately a same size and shape as the first slot and the second slot. Plating the interior surface of the first opening, wherein the plating of the interior surface of the opening forms an electrical connection between the first plated layer and the second plated layer, wherein the first slot, the second slot and the interior surface of the opening form a radiating slot, etching a third slot into a third plated layer, etching a fourth slot into a fourth plated layer, wherein: the third plated layer is on the opposite side of a coupling slot plane from the fourth plated layer and wherein the coupling slot plane comprises a second printed circuit board (PCB). Milling a substrate material of the coupling slot plane to form a second opening between the third slot and the fourth slot, wherein: a size and shape of the second opening is defined by an interior surface of the second opening, and the size and shape of the second opening is approximately a same size and shape as the third slot and the fourth slot. Plating the interior surface of the second opening, wherein the plating of the interior surface of the second opening forms an electrical connection between the third plated layer and the fourth plated layer, wherein the third slot, the fourth slot and the interior surface of the second opening form a coupling slot in the coupling slot plane.

The details of one or more examples of the disclosure are set forth in the accompanying drawings and the description below. Other features, objects, and advantages of the disclosure will be apparent from the description and drawings, and from the claims.

DETAILED DESCRIPTION

The disclosure is directed to a slot antenna that takes advantage of the low-cost, light weight features of a substrate integrated waveguide (SIW) antenna combined with the high efficiency of a metallic antenna. In some examples, the slot antenna may be used as a slot radar antenna. The slot antenna of this disclosure may include a radiated portion and a feed portion. The radiated portion may include a radiating slot plane, radiating waveguides and a feed plane, which may also be called a coupling slot plane. The radiated portion of the slot antenna may use a printed circuit board (PCB) or similar process to create slots and other waveguide features, with accurate dimensions and accurate positions on the antenna assembly. Like a metallic slot antenna, in the slot antenna of this disclosure, radio frequency (RF) energy passes through air, or some other gas, instead of a substrate, which means less insertion loss and high efficiency when compared to a substrate integrated waveguide (SIW) radar antenna. The feed portion of the slot antenna of this disclosure may include a metallic coupling waveguide, which may be referred to as a pedestal or a feed waveguide, to carry the RF energy from the RF generating components of the radar system to each branch of the radiating waveguides of the antenna. The metallic coupling waveguide may be accurately positioned and attached with RF techniques to reduce leakage, mismatch and insertion loss. The metallic coupling waveguide may be configured to provide structural strength and rigidity as well as backwards compatibility to retrofit existing radar systems with the antenna assembly of this disclosure.

The slot antenna of this disclosure may include a line of coupling slots in the center layer of the antenna between radiating waveguides and feed waveguide to drive the various radiated branches of the radiating waveguides. The coupling slots are configured to conduct transmitted RF energy between the feed waveguide to the plurality of radiating waveguides and further to the radiating slots of the radiating slot plane to form the radar transmit beam. The coupling slots are further configured to conduct the received radar signal to the feed waveguide. The received radar signal may come from the reflected version of the radar transmit beam collected by the radiating slot plane after reflecting off a target. Targets may include aircraft, vehicles, clouds or other weather features, and similar objects.

Figure 1:
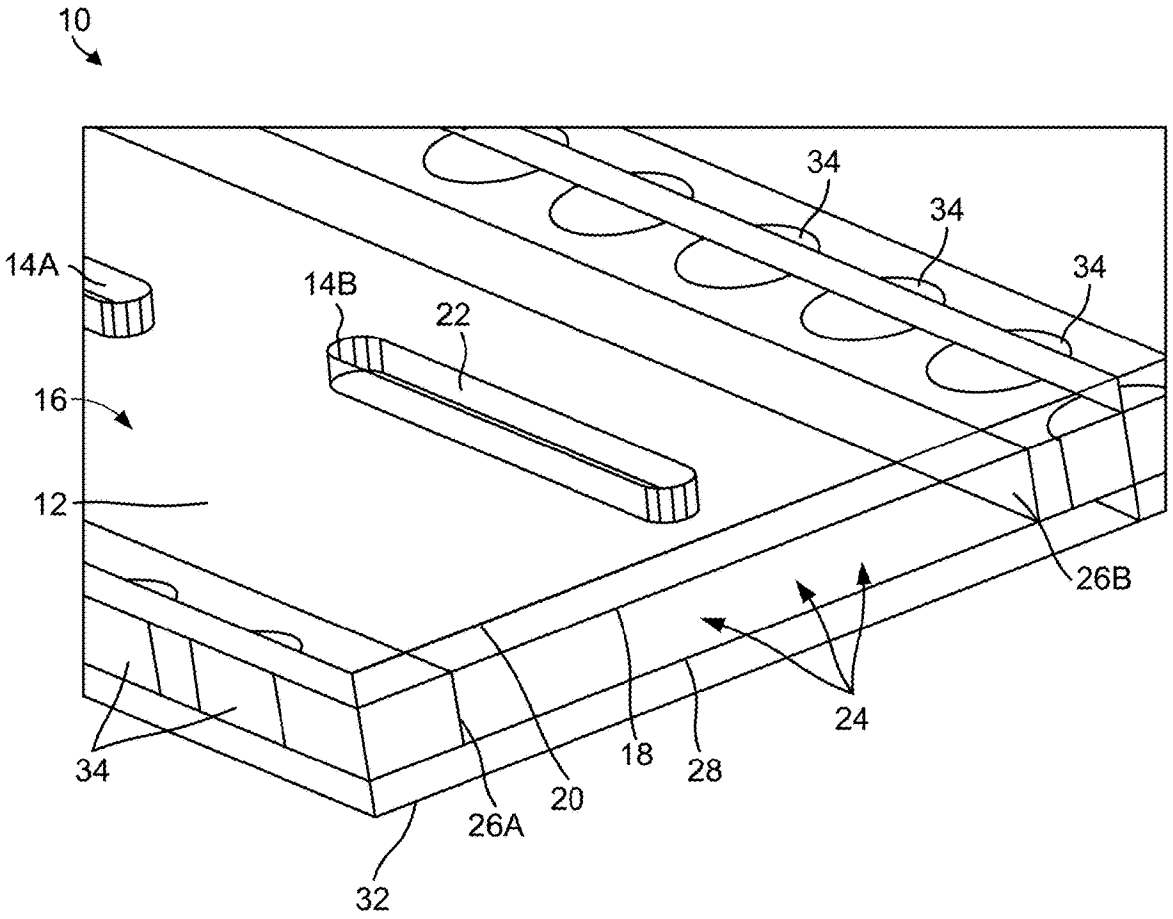
FIG. 1 is a diagram illustrating a portion of a slot antenna in accordance with one or more techniques of this disclosure.

FIG. 1 is a diagram illustrating a portion of a slot antenna in accordance with one or more techniques of this disclosure. FIG. 1 illustrates a sample radiating waveguide comprising electrically conductive surfaces forming an RF conducting path 24 where the RF energy travels through air, or some other gas. Though the slot antenna of this disclosure may be used for other applications, this disclosure will focus on a radar antenna to simplify the description. In some examples a slot antenna, according to the techniques of this disclosure may be used in a mechanical scanning, pulse modulation application, such as a mechanically steered weather radar antenna, such as may be used on an aircraft. In other examples, the slot antenna of this disclosure may be used as a traveling wave antenna that may be steered electronically.

Radar antenna 10 includes a radiating slot plane 12, radiating waveguide layer with walls 26A and 26B and conducting path 24, and coupling slot plane 32. Coupling slot plane 32 may also be referred to as a feed plane in this disclosure. Radar antenna 10 is configured to form a radar transmit beam and transmit RF energy from the radiating slots in the radiating layer. Radar antenna 10 also captures the received radar signal that impinges on the radiating slot plane from the reflected radar transmit beam.

Radiating slot plane 12 includes radiating slots (14A-14B) in a radiating slot array on a printed circuit board (PCB), which includes an outer or first plated layer 16, an inner or second plated layer 18 and a substrate layer 20. Each radiating slot, such as 14A and 14B, (collectively radiating slots 14), includes a plated interior surface 22. The plated interior surface 22 of the radiating slots in the radiating slot array extends from the outer plated layer 16 to the inner plated layer 18 through the substrate layer 20. The plated interior surface 22 of each slot 14A-14B of the radiating slot array is conductive and electrically connects the outer plated layer 16 to the inner plated layer 18.

Substrate layer 20 may include materials used in PCB manufacturing, such as any of the various types of FR4, polyimide-based substrates, epoxy-based or similar substrates. Fiberglass based substrates, such as FR4, may have advantages over other types of substrates in a radar antenna application because of strength, light weight, ability to withstand shock, and wide temperature operating range. In addition, a substrate such as FR4 may have the advantage of significantly lower cost when compared to substrates such as may be used in an SIW application. To efficiently conduct RF energy, substrates in SIW applications may be more expensive, however a slot antenna of this disclosure, which conducts RF energy through a gas, may not need the higher cost substrates.

Each radiating waveguide in the radiating waveguide layer includes an RF energy conducting path 24, which is enclosed by a first wall 26A and a second wall 26B. In some examples, the walls, 26A and 26B may include a substrate material, similar to that in substrate layer 20, which may be plated with a conductive material. Walls 26A and 26B may also include through-holes 34. In some examples, walls 26A and 26B may not be plated with a conductive material. Instead, the interior surface of through-holes 34 may be plated with a conductive material and act as a wall, similar to an SIW wall. Further details on walls 26 and through-holes 34 will be described below in relation to FIG. 2. The conductive plating material of walls 26, through-holes 34 and plated interior surface 22 may be the same material as plated layers 16, 18 and 28. Some examples may include aluminum, copper, or some other conductive alloy or material that may be used in PCB fabrication.

The RF energy conducting path 24 is filled with some type of gas, such as air. When compared to an SIW radar antenna, a radar antenna with the conducting path 24 filled with a gas may have a lower insertion loss than an SIW radar antenna.

The coupling slot plane 32 includes an inner plated layer 28, which may be described as the third plated layer 28, in this disclosure. Inner plated layer 28 forms the fourth side, or plated layer, of conducting path 24. In other words, conducting path 24 is filled with a gas and includes four conductive surfaces: the second, or inner plated layer 18 of the radiating slot plane 12, the third or inner plated layer 28 of the coupling slot plane 32 and walls 26A and 26B. The first wall 26A, the second wall 26B, the second plated layer 18 and the third plated layer 28 are made from an electrically conductive material and are electrically connected to each other and electrically connected to the first plated layer 16 of the radiating slot plane 12.

The slot antenna of this disclosure may have advantages when compared to other types of slot antennae. Any slot waveguide antenna array may be sensitive to the assembling tolerance. That is, a small gap may cause a significant performance problem. Thus, developing slot waveguide antenna array may include high cost and be difficult to control the consistency. A metallic slot antenna may require a costly manufacturing process such as brazing (either salt dip-brazing or vacuum brazing). For example, a thin plate metallic slot radar antenna may be pre-treated with a flux and dipped in a bath of sodium. Sodium bath techniques may be expensive and an environmental hazard, with few manufacturing companies willing or able to effectively manage the process. As of the date of this disclosure the cost of such an antenna may be on the order of US$4000. Machining or 3D printing a metallic radar antenna to the tight tolerances required makes manufacturing a metallic antenna expensive. Other processes, such as 3D printing may be limited by its low speed, high cost and high surface roughness, which may impact antenna performance.

The high cost and the weight may prevent/reduce/eliminate the possibility of using a metallic slot antenna in some applications. For example, the weight of a metallic radar antenna may prevent using the metallic radar antenna on an unmanned aerial vehicle (UAV) or smaller aircraft where weight is important. The higher cost of a metallic radar antenna may put a system including a metallic radar antenna out of reach for some privately-owned aircraft, or other applications where cost is important.

An SIW slot antenna is a form of transmission line that creates a waveguide within a substrate, such as a PCB. The waveguide in an SIW radar antenna may consist of two lines of holes as the wall of rectangular waveguide and the metallic layer on the top and bottom to form a rectangular enclosure around the substrate. The waveguide of an SIW radar antenna suffers higher insertion loss than the air in an aluminum waveguide. The insertion loss may be caused by the substrate, the gap between holes and the surface roughness between metallic layer and the substrate. An SIW antenna array brings advantages such as high integration, a thin profile and light weight. However, for those applications that require very high efficiency, the SIW technique may be limited.

Figure 2:
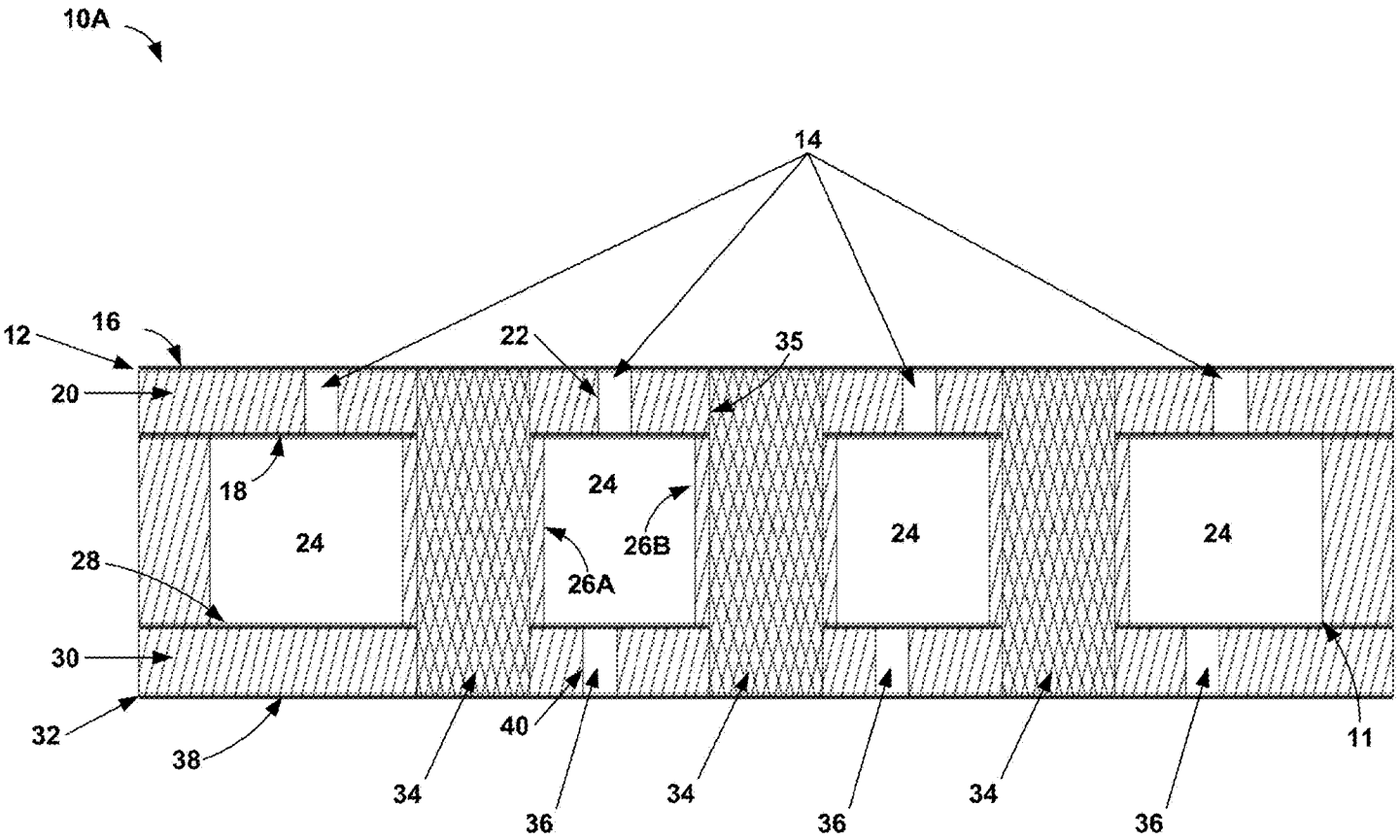
FIG. 2 is a diagram illustrating a side view of a portion of a slot antenna in accordance with one or more techniques of this disclosure.

FIG. 2 is a diagram illustrating a side view of a portion of a slot antenna in accordance with one or more techniques of this disclosure. Features with reference numbers in FIG. 2 that are the same as the reference numbers in FIG. 1, or other FIGS. in this disclosure, indicate the same feature that performs the same function. FIG. 2, as with FIG. 1, is one example implementation of the radar antenna of this disclosure. Other examples may include features not shown, or exclude features depicted in the figures. For example, in some implementations, a radar antenna in accordance with the techniques of this disclosure may not include through-holes 34. Moreover, FIG. 2 is not shown to scale, as some dimensions of FIG. 2 have been altered for ease of understanding.

Radar antenna 10A depicted in FIG. 2 includes four radiating waveguides 11 in the radiating waveguide layer. The number of radiating waveguides are for illustration only and other examples in the figures below will depict additional radiating waveguides. For clarity, only one of the four radiating waveguides 11 includes a reference number. As described above in relation to FIG. 1, each radiating waveguide 11 includes an RF energy conducting path 24 enclosed by an inner plated layer 18, walls 26A and 26B and an inner plated layer 28. Inner plated layer 18 is the second plated layer or inner plated layer of radiating slot plane 12 while inner plated layer 28 is the third plated layer or inner plated layer of coupling slot plane 32. Conducting path 24 may be filled with a gas, such as air, argon, or other gas. In some examples, wall 26A may be substantially parallel to wall 26B. Walls 26A and 26B may be substantially perpendicular to inner plated layer 18 and inner plated layer 28. The terms substantially and approximately, as used in this disclosure mean dimensions or positioning within manufacturing and measurement tolerances.

The first wall 26A, the second wall 26B, the second plated layer 18 and the third plated layer 28 are made from an electrically conductive material and are electrically connected to each other and electrically connected to the first plated layer 16 of the radiating slot plane 12 as well as the outer plated layer 38 of coupling slot plane 32.

As described above in relation to FIG. 1, coupling slot plane 32 includes an inner plated layer 28. Coupling slot plane 32 also includes an outer plated layer 38 and coupling slots 36. Coupling slots 36 includes a plated interior surface 40 that electrically connects inner plated layer 28 to outer plated layer 38. In other words, in some examples all four plated layers depicted in FIG. 2, that is, outer plated layer 16, inner plated layer 18, inner plated layer 28 and outer plated layer 38 may all be electrically connected via radiating slots, coupling slots and/or through-holes 34, described in more detail below. The plated interior surface 40 of coupling slots 36 is similar to plated interior surface 22 of radiating slots 14, which is also depicted in FIG. 1. For clarity, only one plated interior surface 22 and plated interior surface 40 has a reference number in FIG. 2. However, each of the radiating slots 14 and coupling slots 36 includes a plated interior surface 22 and plated interior surface 40, respectively.

In some examples, plated interior surface 40 may be substantially perpendicular to inner plated layer 28 and outer plated layer 38. Inner plated layer 28 may be substantially parallel to outer plated layer 38. Similarly, plated interior surface 22 may be substantially perpendicular to inner plated layer 18 and outer plated layer 16. Inner plated layer 18 may be substantially parallel to outer plated layer 16.

As described above in relation to FIG. 1, each wall, such as 26A or 26B (collectively called walls 26), may include substrate material with through-holes 34. The surfaces of walls 26, such as the surfaces indicated by reference numbers 26A and 26B may be plated with a conductive material, such as copper or similar material. In some examples, through-holes 34 may not include a plated interior surface and form no electrical connection. Some examples walls 26 plated with conductive material may have no through-holes 34.

In some examples, through-holes 34 may include a plated interior surface 35, similar to interiors plated surface 22 and plated interior surface 40 of radiating slots 14 and coupling slots 36, respectively. In some examples, through-holes 34 may penetrate the substrate 30 and inner plated layer 28 of coupling slot plane 32. Through-holes 34 may also penetrate the inner plated layer 18 and substrate 20 of radiating slot plane 12. However, in some examples, through-holes 34 do not penetrate outer plated layer 16 of radiating slot plane 12, nor the outer plated layer 38 of coupling slot plane 32. Through-holes 34 may electrically connect outer plated layer 16 to outer plated layer 38. In some examples, through-holes 34, with plated interior surfaces 35, may also electrically connect inner plated layers 18 and 28 to outer plated layers 16 and 38.

Through-holes 34 with a plated interior surface that electrically connect outer plated layers 16 and 38 may be configured to act as the walls of radiating waveguides 11, similar to SIW techniques. The diameter and spacing of through-holes 34 may depend on the operating frequency and other parameters of the radar antenna. The conducting path 24 of the radiating waveguides 11 may include a gas rather than a substrate, such as the substrate found in SIW techniques. In examples of a radar antenna according to this disclosure that use conductive through-holes 34 as walls, the surfaces of walls 26 may not be plated with a conductive material. In other words, a conducting path 24 of a radar antenna according to this disclosure may include several configurations. A first configuration may include walls 26 plated with a conductive material. A second configuration may include walls 26 with no conductive plating and through-holes 34 that have the interior surface of the through-holes plated with a conductive material that acts as the walls of conducting path 24, similar to SIW techniques.

In this second configuration, it may be desirable to configure the distance between the surface of the unplated wall 26 and the inner plated surface of through hole 34 to be a small distance. In some examples, the distance between the surface of the unplated wall 26 and the inner plated surface of through hole 34 may be less than 0.5 mm, which may reduce insertion loss caused by exposed substrate material in the conducting path 24. Other configurations may include some combination of through-holes 34 and plated or unplated walls 26.

In some examples, the substrate of the radiating slot plane and coupling slot layer may be a copper clad plate or copper clad layer (CCL) in which copper, or another conductive material, covers both sides of a 2-layer CCL. The location of the radiating slots, coupling slots and other features may be placed on the CCL with high accuracy that may be part of a PCB manufacturing process, for example by etching, or some similar process. As described above, accurate feature placement in a slot radar antenna may have advantages of improved performance, such as efficient RF energy conduction, accurate beam forming, reduced sidelobes and other performance factors.

A slot radar antenna according to the techniques of this disclosure may have advantages over metallic slot radar antennae. As one example, a slot radar antenna of this disclosure may potentially be built at a lower cost and be lighter in weight than a metallic slot radar antenna. An RF energy conducting path filled with a gas, such as conducting path 24 may have advantages over an SIW because an RF energy conducting path filled with a gas may have lower insertion loss when compared to SIW.

A radar antenna of this disclosure may also perform under extremes of operating conditions while maintaining high performance standards. For example, a radar antenna for a weather radar attached to an aircraft may be subjected to extremes in temperature, such as on the ground in an airport on a hot day compared to sub-zero temperatures at 30,000 feet. Some examples of the radar antenna of this disclosure were tested from −75° C. to +100° C. as well as subjected to condensing water and freezing cycles, with damage to the antenna nor impact to the RF performance.

Figure 3:
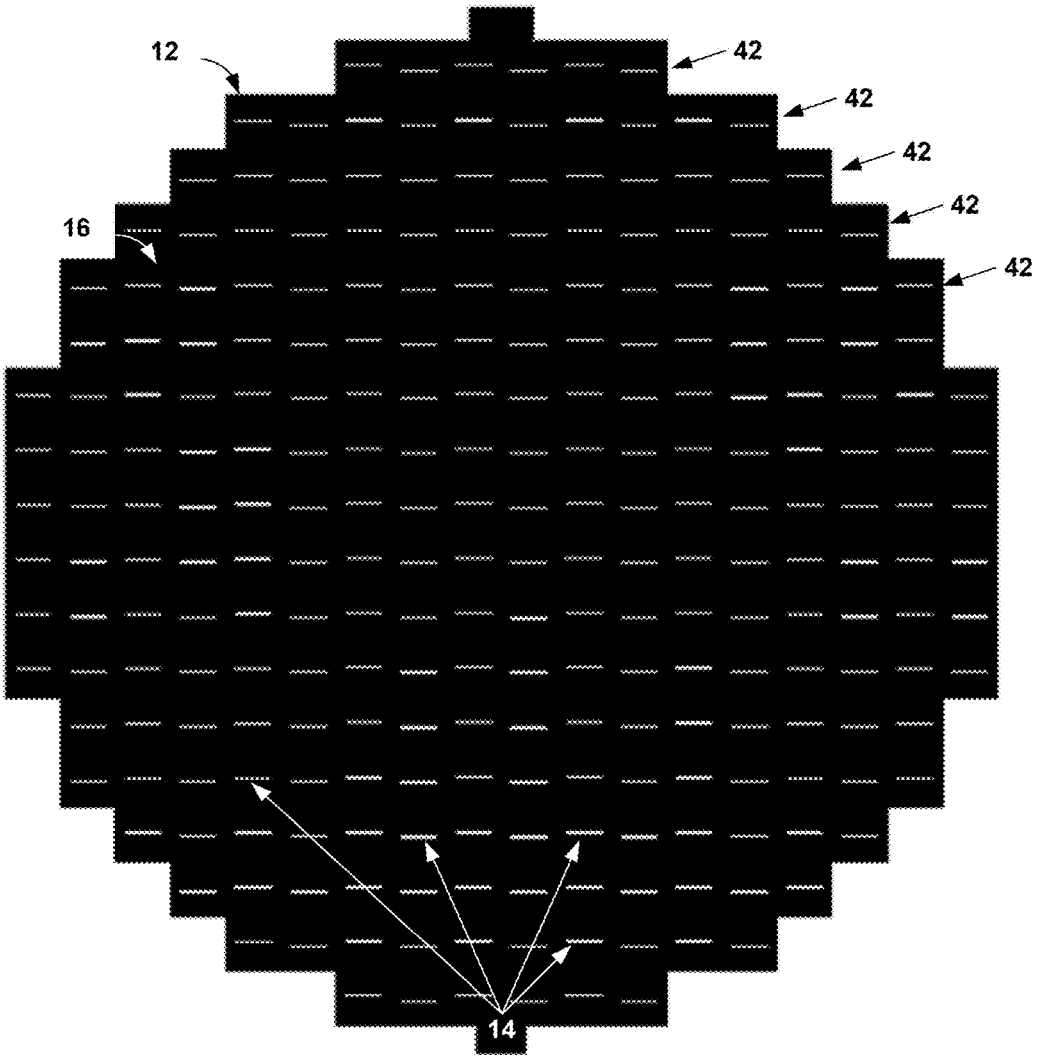
FIG. 3 is a diagram illustrating a top view of the radiating slot plane of a slot antenna in accordance with one or more techniques of this disclosure.

FIG. 3 is a diagram illustrating a top view of the radiating slot plane of a slot antenna in accordance with one or more techniques of this disclosure. The radiating slot plane 12 of FIG. 3 is one example shape and configuration of a radar antenna of this disclosure. Other examples may include other shapes and configurations.

Radiating slot plane 12 includes outer plated layer 16 and a plurality of radiating slots 14 in a plurality of slot rows 42. For clarity, only a few of the slot rows 42 have a reference number. Each of the slot rows 42 may correspond to and align with a radiating waveguide, such as radiating waveguide 11 depicted in FIG. 2. The length and width of each slot 14 may depend on the operating frequency range of a radar system or radar device connected to the radar antenna. The final radiating slots 14 at each end of a slot row 42 may be placed at a specific distance from the termination end of the radiating waveguide. The specific distance may depend on the operating frequency, antenna material, number of radiating slots 14 in a respective slot row 42, type of end structure at the end of each slot row 42, such as plated termination or plated through hole termination, and other factors. In some examples, the operating frequency may be in the millimeter wave range or in the microwave range.

The radiating slots 14 may be offset from each other along a slot row 42. The degree of offset may depend on the position of slot in the slot row, such as closer to the middle of a slot row 42 or closer to the end of a slot row 42, as well as the number of radiating slots 14 in a respective slot row 42. The position of a radiating slot 14 may be related to energy distribution and beam forming performance. Adjusting the relative position of a radiating slot with respect to the walls of the radiating waveguide 11 (not shown in FIG. 3) as well as relative to other radiating slots may be selected to control the shape and performance of the radar transmit beam, such as to reduce sidelobes.

Figure 4:
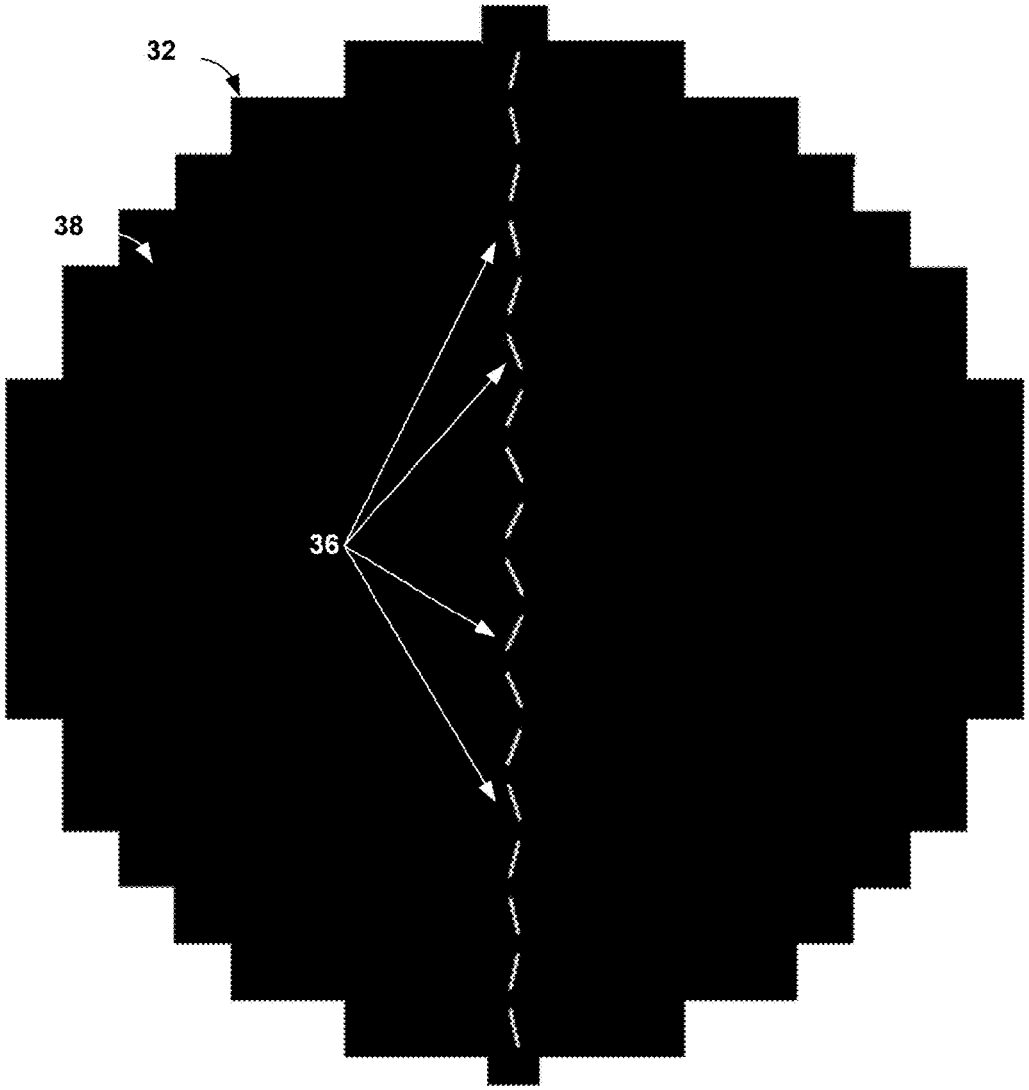
FIG. 4 is a diagram illustrating a top view of the coupling slot layer of a slot antenna in accordance with one or more techniques of this disclosure.

FIG. 4 is a diagram illustrating a top view of the coupling slot layer of a slot antenna in accordance with one or more techniques of this disclosure. Coupling slot plane 32, which includes outer plated layer 38 and coupling slots 36, includes the same functions and characteristics as described above in relation to FIGS. 1 and 2.

FIG. 4 depicts a row of coupling slots 36 in the center of outer plated layer 38. In the example of FIG. 4, each coupling slot corresponds to a respective radiating waveguide 11, as depicted in FIG. 2, and with a respective slot row 42 as depicted in FIG. 3. A respective coupling slot is configured to conduct transmitted RF energy between the feed waveguide to air in the conducting path 24 of a respective radiating waveguide 11. In other words, the respective coupling slot is configured to couple the feed waveguide RF energy path to the radiating waveguide RF energy path, conducting path 24. Conducting path 24 (not shown in FIG. 4) further conducts transmitted RF energy to the radiating slots 14 of the radiating slot plane 12 to form the radar transmit beam. Coupling slots 36 are further configured to conduct a received radar signal to the feed waveguide from the reflected version of the radar transmit beam as collected by radiating slot plane 12. The feed waveguide (not shown in FIG. 4) will be described in more detail below.

The example of FIG. 4 depicts coupling slots 36 and various angles to each other. Adjusting the angle of a respective coupling slot may impact the amount of energy the coupling slot conducts from the feed waveguide to the radiating waveguide 11. Adjusting the angle of the coupling slot 36 may adjust the distribution of RF energy through the radar antenna. Adjusting the distribution of energy may impact the shape and formation of the RF transmit beam, for example to reduce energy lost to sidelobes. The length and width of the coupling slots 36 may depend on the operating frequency range of the radar antenna, as described above for the radiating slots 14.

Figure 5:
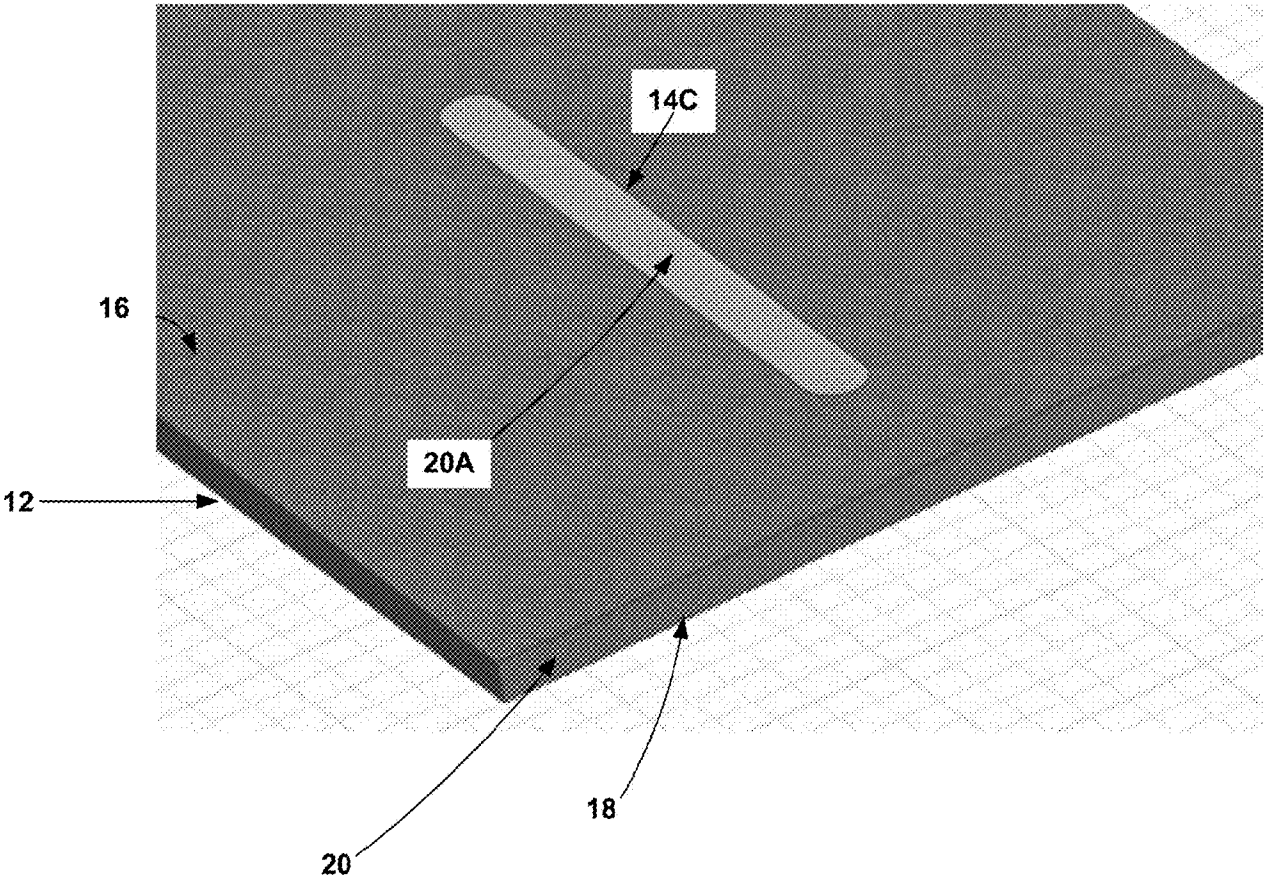
FIG. 5 is a diagram illustrating etching a slot shape for the top and bottom conductive layer.
Figure 6:
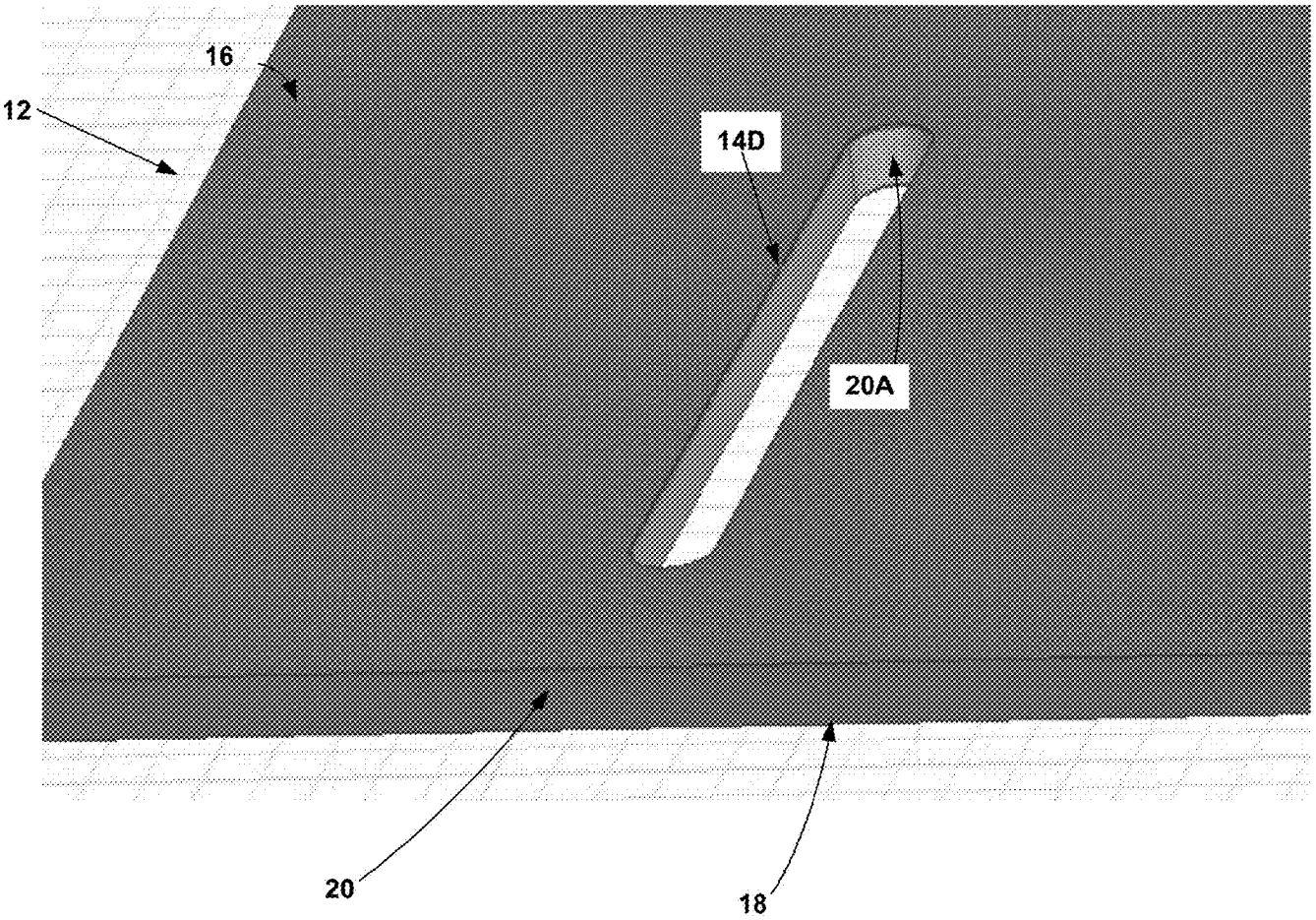
FIG. 6 is a diagram depicting an example milled out slot shape with the substrate material removed.
Figure 7:
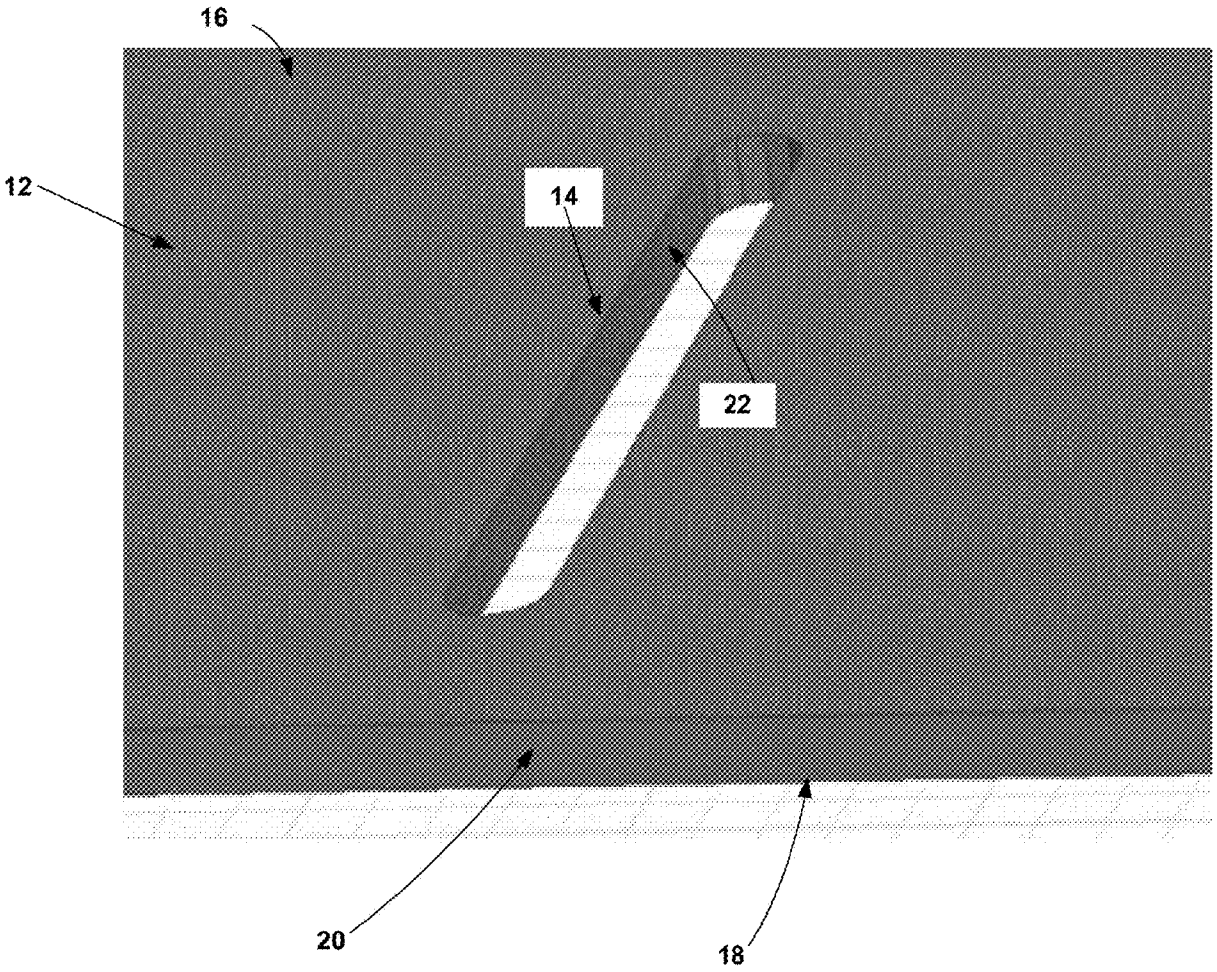
FIG. 7 depicts an example milled out slot shape with the interior surface plated with a conductive material.

FIG. 5 is a diagram illustrating etching a slot shape for the top and bottom conductive layer. FIGS. 5-7 depict an example process for creating radiating slots 14 or coupling slots 36. The example of FIGS. 5-7 will focus on radiating slots as an example, but a similar process may be used for coupling slots.

FIG. 5 depicts etching a single radiating slot 14C in radiating slot plane 12. Radiating slot plane 12, as described above in relation to FIGS. 1-3, includes outer plated layer 16, inner plated layer 18 and substrate 20. In some examples, radiating slot plane 12 may start as a copper clad PCB multi-layer assembly, which means outer plated layer 16 and inner plated layer 18 may comprise copper plating over a PCB substrate, such as FR4 or similar substrate. Other conductive materials may also be suitable for outer plated layer 16 and inner plated layer 18.

The example of FIG. 5 depicts using PCB manufacturing techniques to etch the location and dimensions of radiating slot 14C into the surface of outer plated layer 16 and inner plated layer 18. The etching process may expose substrate material 20A in the etched region of slot 14C. For clarity, only the etched side of outer plated layer 16 is shown in FIG. 5.

FIG. 6 is a diagram depicting an example milled out slot shape with the substrate material removed. In some examples, a laser milling process may be used to remove substrate material 20A from radiating slot 14D. Some examples of laser milling may only remove the substrate material and not affect the conductive material, such as a copper clad material. Therefore, laser milling may have advantages in retaining the accuracy, consistency and repeatability of the PCB etching process for the slot location and dimensions, as well as forming smooth edges. Radiating slot plane 12, depicted in FIG. 6, includes outer plated layer 16, inner plated layer 18 and substrate 20 and substrate 20A surrounding the interior surface of radiating slot 14D.

FIG. 7 depicts an example milled out slot shape with the interior surface plated with a conductive material. Plating the interior surface 22 of slot 14 with a conductive material provides an electrical connection between outer plated layer 16 and inner plated layer 18.

As described above, the performance of a slot antenna may be impacted by the accurate location of the radiating slots 14 and coupling slots 36 as well as accurate the dimension of slot shape. In some examples, using computer numerical control (CNC) techniques to make these slots directly in a PCB, the accuracy is may not result in the desired performance for a slot waveguide antenna array. Therefore, the weight advantages of the CCL PCB may be overshadowed by less efficient performance. The PCB etching combined with laser, or other accurate milling techniques, as described in this disclosure, may have advantages over other techniques.

Figure 8:
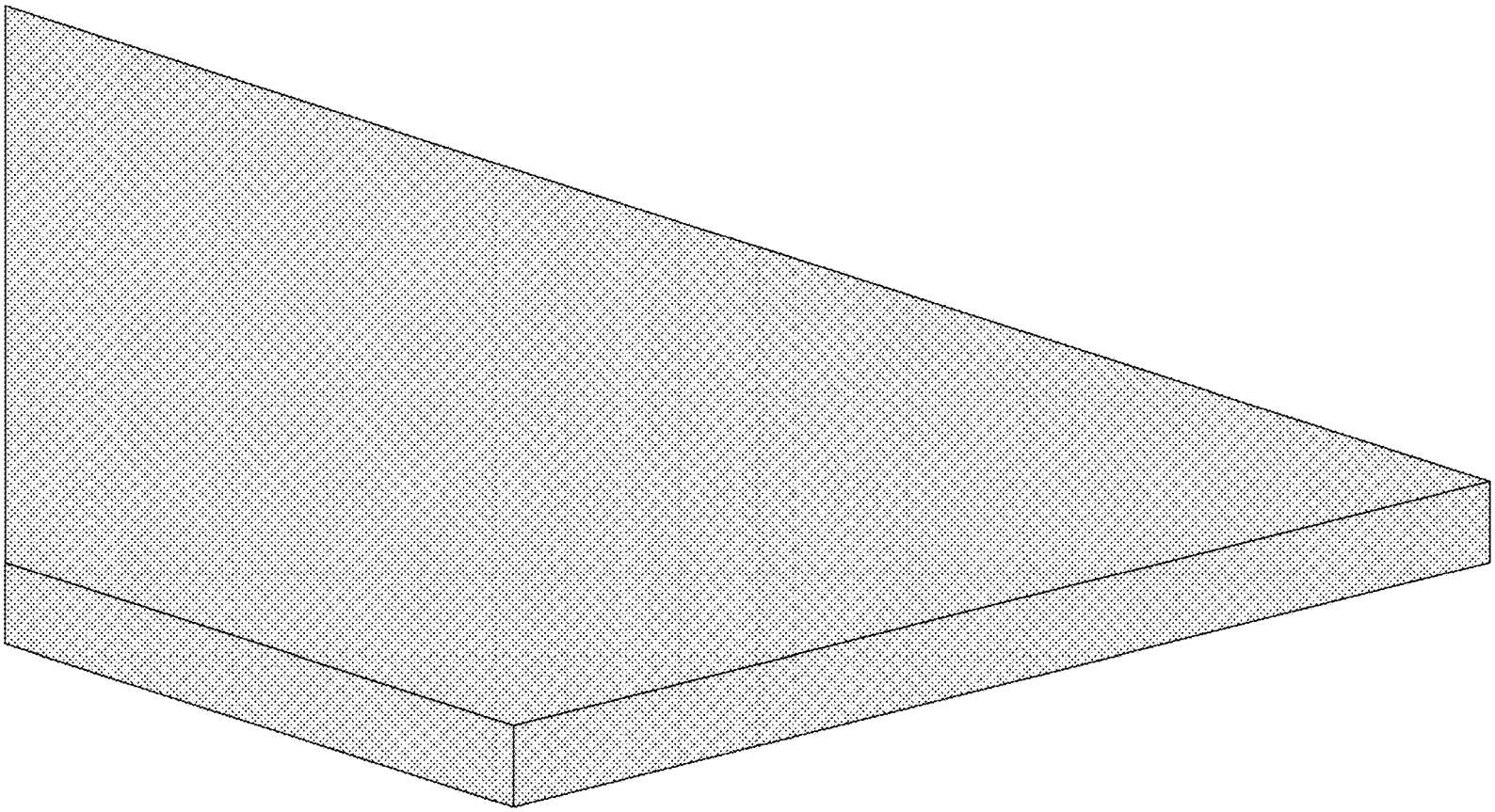
FIG. 8 depicts an example radiating waveguide portion before forming the radiating waveguides.
Figure 9:
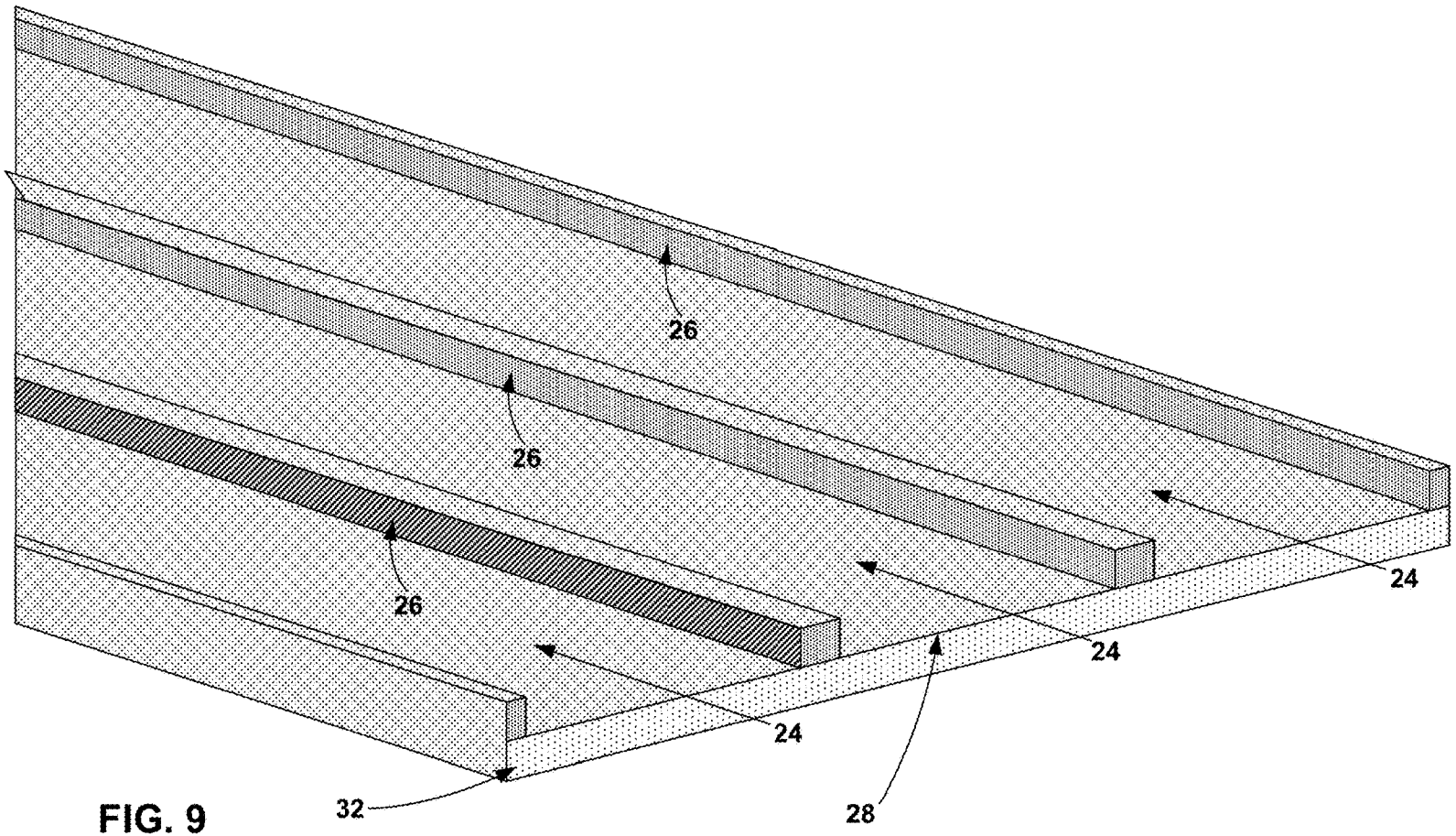
FIG. 9 depicts an example radiating waveguide portion with the radiating waveguides partially formed.
Figure 10:
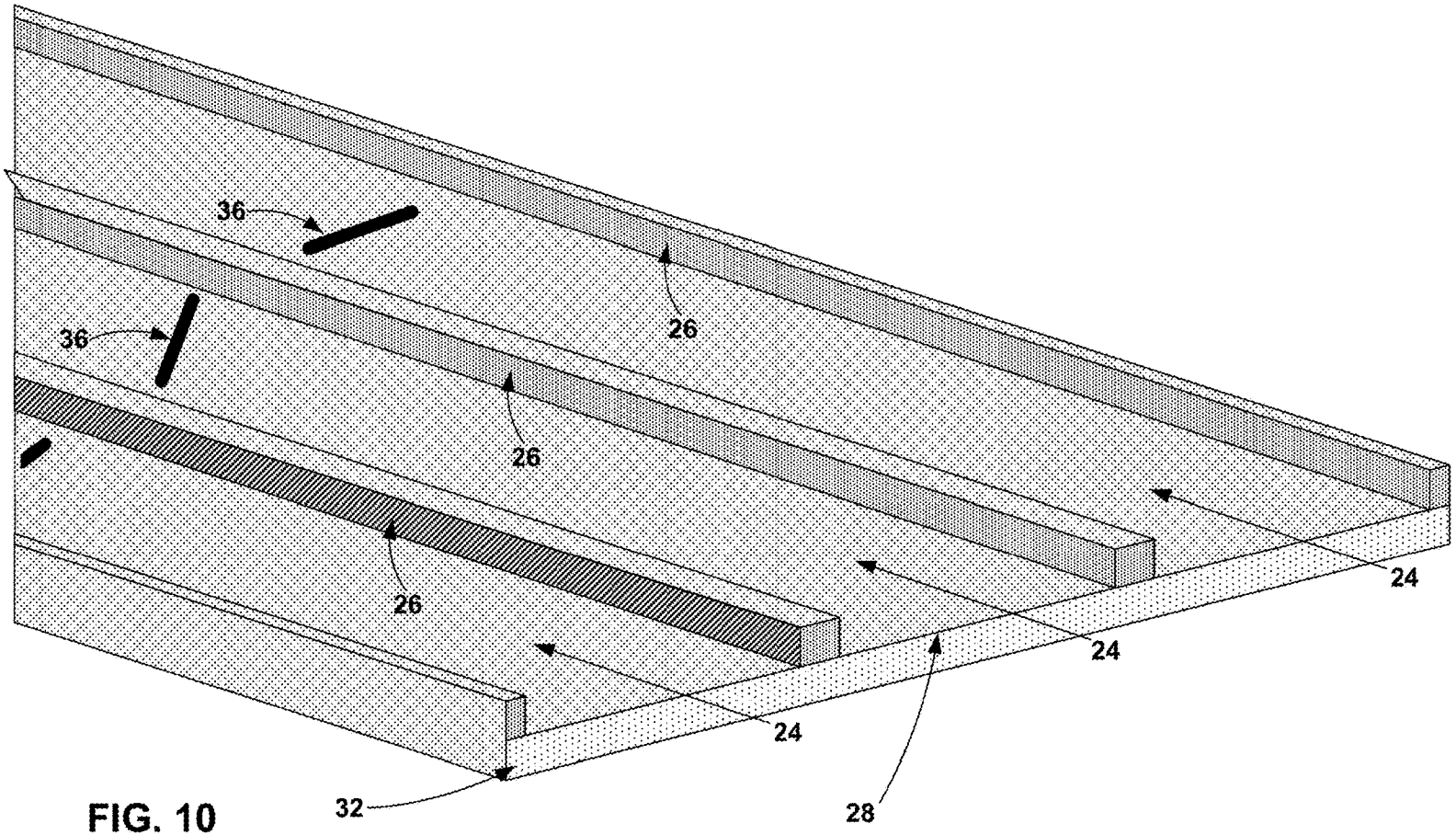
FIG. 10 depicts an example radiating waveguide portion with the radiating waveguides partially formed and coupling slots visible.

FIGS. 8-10 depict an example of processing steps that may be used to make the radiating waveguides of the radiated portion of a radar antenna, according to one or more techniques of this disclosure. FIG. 8 depicts an example radiating waveguide portion before forming the radiating waveguides.

FIG. 9 depicts an example radiating waveguide portion with the radiating waveguides partially formed. Comparing FIGS. 8 and 9 shows the substrate material between walls 26 may be removed, for example, by a PCB manufacturing process. Some examples of processes to remove the substrate material to form walls 26 may include mechanical milling, or some similar process. In some examples, the substrate material to form the walls may be bonded to either the radiating slot plane 12 or the coupling slot plane 32. Following bonding, a process may remove substrate material in the radiating waveguide portion to form walls 26. In other examples, walls 26 may be created by another process and bonded to either the either the radiating slot plane 12 or the coupling slot plane 32. The example of FIG. 9 depicts the radiating waveguide portion bonded to coupling slot plane 32.

As described above in relation to FIG. 2, in some examples, the surfaces of walls 26 may be plated with a conductive material that is electrically connected to inner plated layer 28 of coupling slot plane 32. In other examples, through-holes 34 (not shown in FIG. 9) may be drilled or otherwise formed in walls 26. The interior surface of through-holes 34 may be plated to form the walls of conducting path 24. In some examples with plated through-holes 34, the surfaces of walls 26 may not be plated.

FIG. 10 depicts an example radiating waveguide portion with the radiating waveguides partially formed and coupling slots visible. In some examples coupling slots 36 may be formed after forming walls 26, for example by etching and milling as described above in relation to FIGS. 5-7. In other examples, walls 26 may be bonded to coupling slot plane 32 after forming coupling slots 36.

Figure 11:
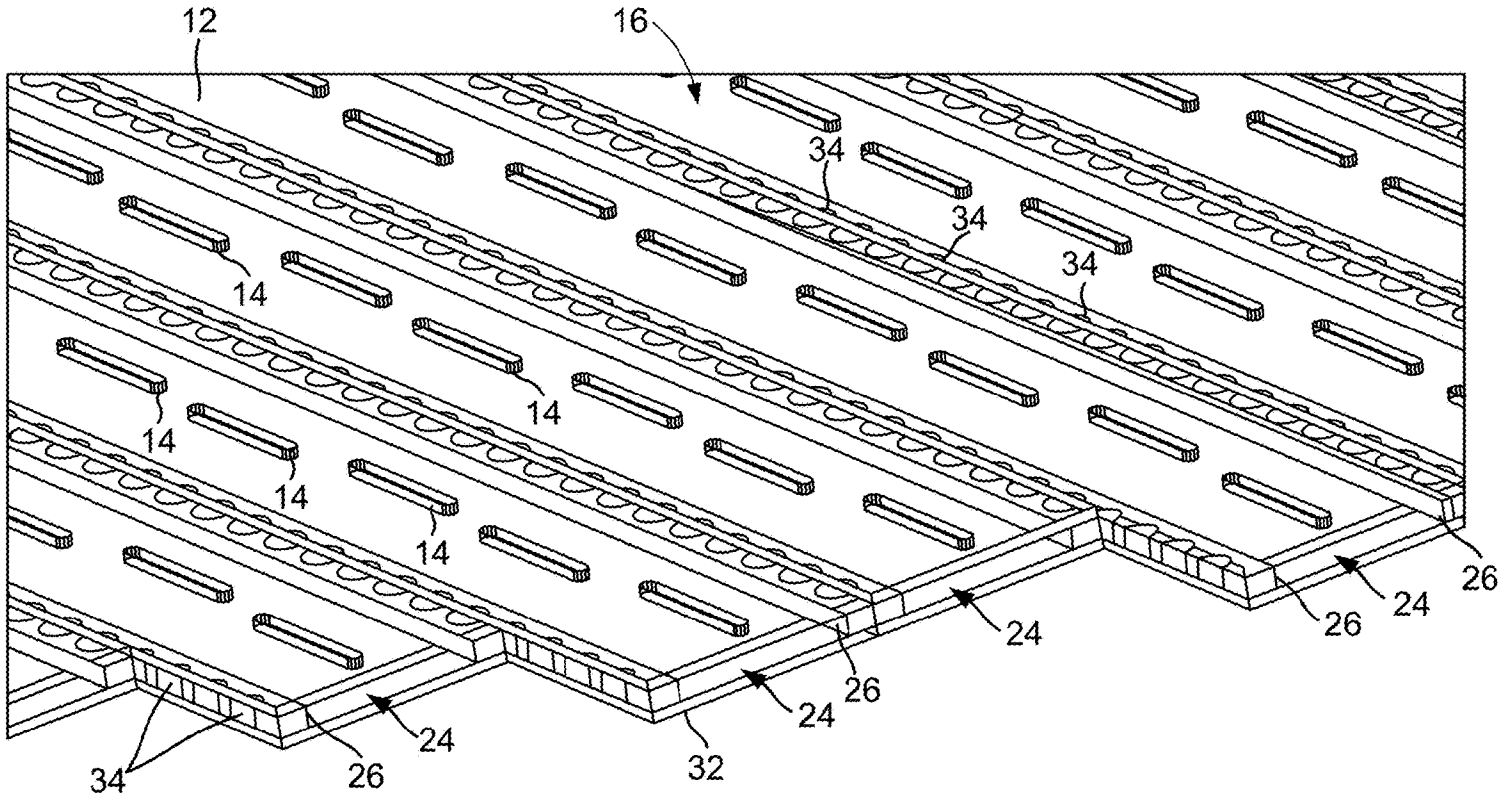
FIG. 11 depicts an isometric view of a plurality of radiating waveguides of a radar antenna according to one or more techniques of this disclosure.

FIG. 11 depicts an isometric view of a plurality of radiating waveguides of a radar antenna according to one or more techniques of this disclosure. FIG. 11 illustrates radiating slot plane 12, radiating waveguide layer with walls 26 and conducting path 24 and a coupling slot plane 32, which correspond to similar features describe above in relation to FIGS. 1-10. The view of FIG. 11 illustrates a portion of the example perimeter shape as depicted in FIGS. 3 and 4 as well as how the radiating waveguides may correspond to slot rows 42 as depicted in FIG. 3.

The example of FIG. 11 depicts through-holes 34, which may include plated interior surfaces to act as walls of conducting paths 24 of the radiating waveguides. As described above, in other examples, the surfaces of walls 26 may be plated with copper or other conductive material to contain and direct the RF energy that may pass through conducting path 24. As described above, the diameter and spacing of through-holes 34 are features of the radar antenna of this disclosure that may depend on the operating frequency and other parameters of the radar antenna.

The example of FIG. 11 depicts an example size, spacing and location of radiating slots 14, including the offset in relation to walls 26 and to the other radiating slots as described above in relation to FIG. 3. As described above, accurate feature placement in a slot radar antenna may have advantages of improved performance, such as efficient RF energy conduction, accurate beam forming, reduced sidelobes and other performance factors. A slot radar antenna according to the techniques of this disclosure may take advantage of the accuracy of PCB manufacturing techniques as well as the advantages of low insertion loss from a conducting path filled with a gas, such as conducting path 24.

Though not shown in FIG. 11, some examples of the radar antenna of this disclosure may include additional PCB layers that may include radar circuitry, such as radar transmit electronics, radar receiver electronics, processing circuitry, up and down conversion circuitry, analog and digital circuitry and similar radar electronics.

Figure 12:
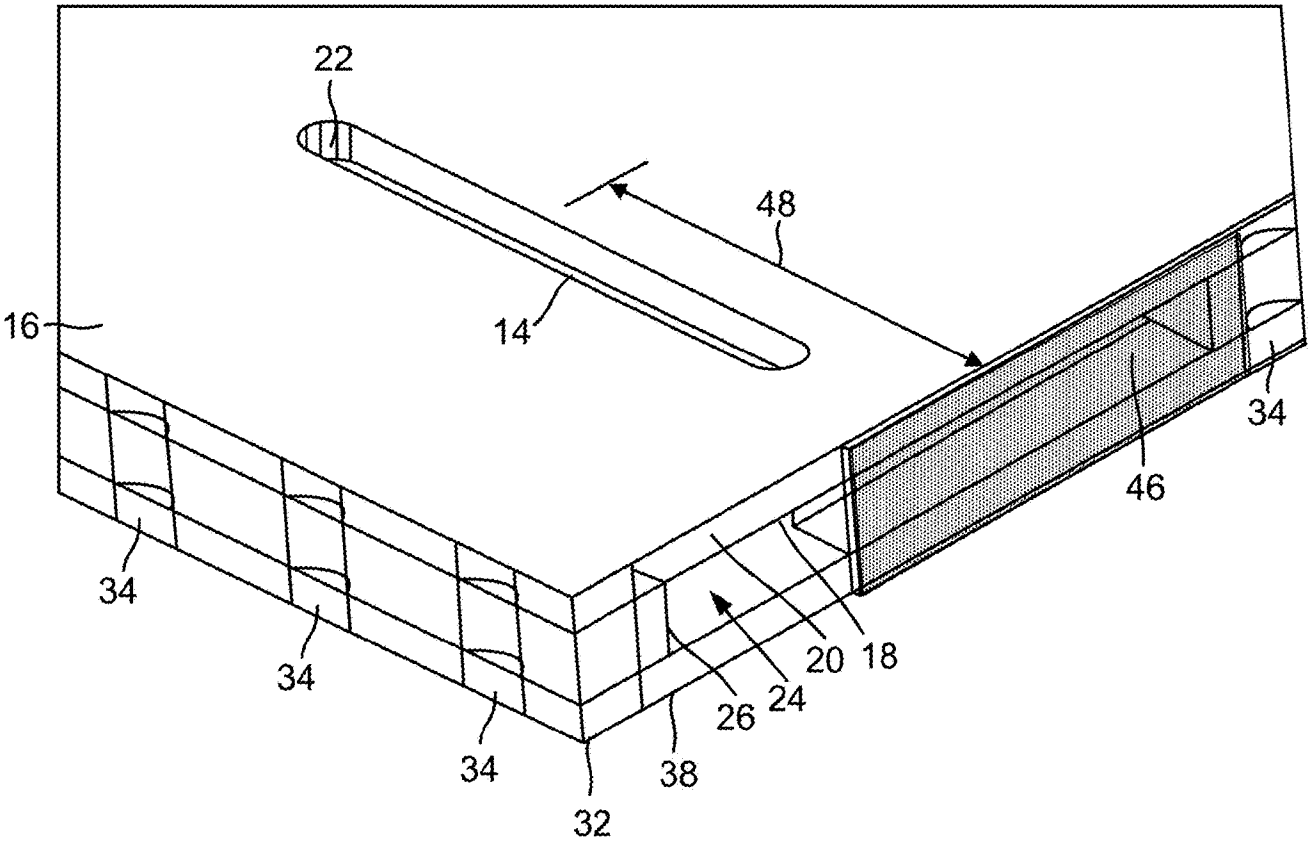
FIG. 12 is a diagram illustrating a portion of a radar antenna including a radiating waveguide termination, in accordance with one or more techniques of this disclosure.

FIG. 12 is a diagram illustrating a portion of a radar antenna including a radiating waveguide termination, in accordance with one or more techniques of this disclosure. FIG. 12 includes reference numbers to features also found in other figures in this disclosure, such as radiating slot plane 12 with outer or first plated layer 16 inner or second plated layer 18 and a substrate layer 20, through-holes 34, coupling slot plane 32 with outer plated later 38, and conducting path 24.

Termination edge 46 may be a conductive material that may be electrically connected to, for example, outer plated layer 16, inner plated layer 18 and the conductive interior surface of through-holes 34. Termination edge 46 may contain and direct the RF energy in conducting path 24 of the radiating waveguide. Termination edge 46 may be formed on the end of each respective radiating waveguide after other features of the radar antenna are formed. For example, termination edge 46 may be formed after bonding radiating slot plane 12, walls 26 and coupling slot plane 32 together.

In some examples, termination edge 46 may completely enclose conducting path 24. In other examples, as depicted in FIG. 12, termination edge 46 may only partially enclose the end of conducting path 24. In other words, conducting path 24 may have an opening at termination edge 46. The size of the opening may depend on the operating frequency of the antenna. In some examples, an opening in conducting path 24 left by a termination edge 46 that partially covers the end of conducting path 24 may be desirable to release humidity, condensed moisture or particles, such as dust, that may enter conducting path 24.

FIG. 12 depicts example radiating slot 14 with plated interior surface 22 at a distance 48 from termination edge 46. As described above, accurate feature placement in a slot radar antenna, such as the location of a final radiating slot 14 of a slot row 42 (depicted in FIG. 3) in relation to the termination edge 46 may have advantages of improved radar antenna performance. Distance 48 may depend on the operating frequency range of the radar antenna. The radar antenna of this disclosure may utilize the accuracy of PCB manufacturing techniques for accurate feature placement at a reduced cost when compared to machining a metallic radar antenna.

Figure 13:
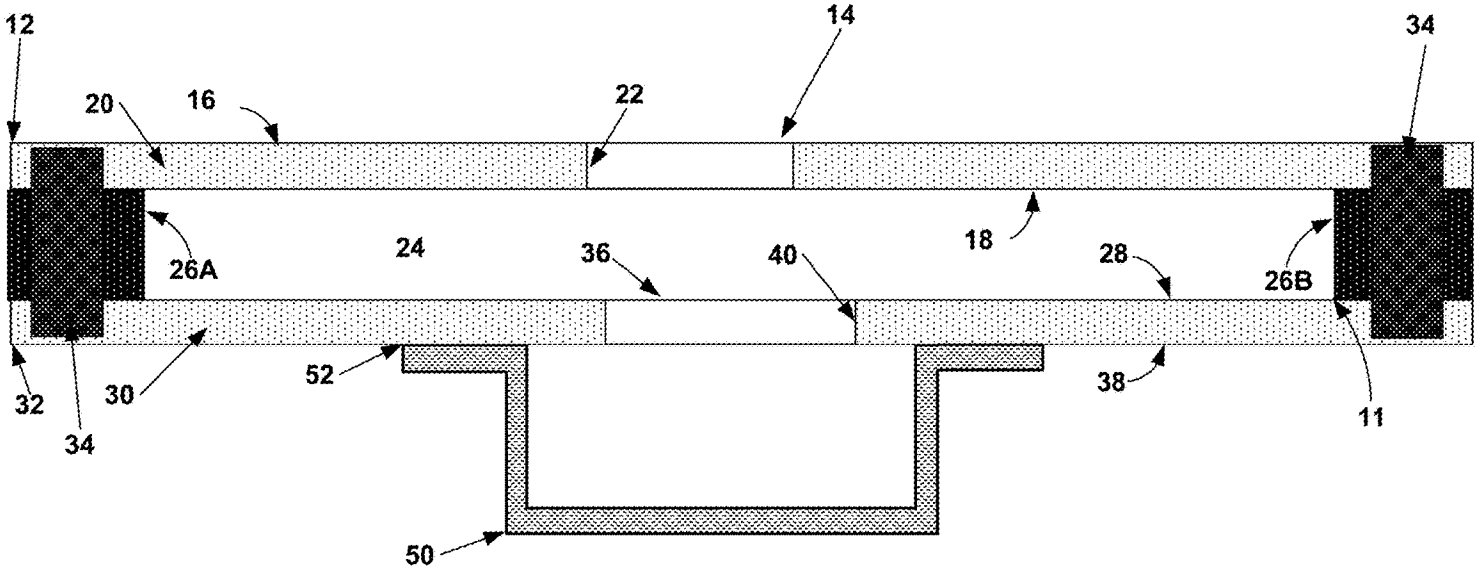
FIG. 13 is a diagram illustrating a cut-away view of an example portion of a radar antenna including a radiated portion and a feed portion.

FIG. 13 is a diagram illustrating a cut-away view of an example portion of a radar antenna including a radiated portion and a feed portion. The radiated portion may include a radiating slot plane 12, radiating waveguides 11 and a feed plane, which may be referred to as a coupling slot plane 32. The feed portion of the radar antenna of this disclosure may include a metallic coupling waveguide, which may be referred to as a pedestal, a driving waveguide or a feed waveguide 50, to carry the RF energy from the RF generating components of the radar system to each branch of the radiating waveguides 11 of the antenna.

Feed waveguide 50 may be machined from aluminum, or other similar material and bonded to the radiating portion at bonding region 52. Feed waveguide 50, may be bonded to outer plated layer 38 of coupling slot plane 32 by a variety of methods that may ensure good connection. RF manufacturing techniques to connect feed waveguide 50 to the radiating portion in an accurate position may be desirable to reduce RF energy leakage, mismatching and insertion loss. Some examples of bonding techniques may include soldering, such as with tin, as well as silver epoxy or other conductive adhesive. In some examples, the aluminum portions of the antenna assembly may be plated with nickel to improve the soldering connection. In some examples, a fixture may be developed to press the components together to ensure even weight distribution during assembly. In some examples positioning studs or other protrusions may be formed in feed waveguide 50 to align with holes, such as via holes, in the PCB portions of coupling slot plane 32 for accurate positioning.

The example of FIG. 13 depicts feed waveguide 50 configured to cover coupling slots 36 to transfer transmitted RF energy to the plurality of radiating waveguides 11 as well as transfer reflected received RF energy from the radiating waveguides 11 to receiving electronics of a radar system. This configuration is also depicted in FIG. 14B.

As described above, for example in relation to FIGS. 1 and 2, the additional features of the radiating portion depicted in FIG. 13 include walls 26A and 26B, through-holes 34, inner plated layers 18 and 28, which border conducting path 24. Coupling slot 36 includes plated interior surface 40, and radiating slot 14 includes plated interior surface 22, which forms an electrical connection to outer plated layer 16. Radiating slot plane 12 includes substrate 20 and coupling slot plane includes substrate 30. As described above, various materials may be used as a substrate. FR4 is an example of a low cost substrate material that may be suitable for a radar antenna with air in the conducting path 24, according to the techniques of this disclosure. FR4 may have advantages in cost when compared to an SIW antenna, which may require a more costly high frequency, low dielectric constant (Dk) and low insertion loss substrate material.

In some examples, a feed waveguide may be formed by additional PCB layers rather than a metal feed waveguide such as feed waveguide 50. A metal feed waveguide may have advantages over additional PCB layers because the stack-up of PCB layer structure may make the PCB process more complex and costly. Also, the total thickness of the PCB may be limited depend on the capability of different PCB manufacturers. The combination of a radiated branch waveguide on the PCB board and a one-side open metal pedestal to form the feed waveguide and provide structural support along with RF manufacturing techniques may offer advantages of lightweight, low cost, and efficient radar antenna performance when compared to other techniques. The one-side open metallic coupling waveguide may have advantages in lower cost and easier to manufacture when compared to machining a more complex metallic slot waveguide antenna.

Figure 14A:
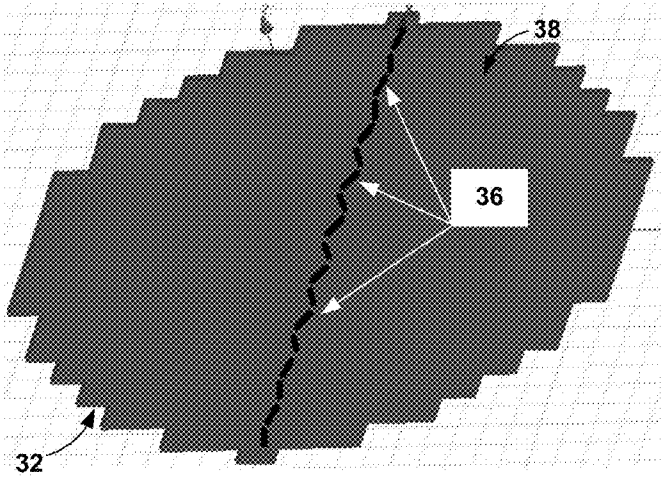
FIG. 14A is a diagram illustrating an isometric view of a coupling slot plane of the radiating portion of a radar antenna according to one or more techniques of this disclosure.
Figure 14B:
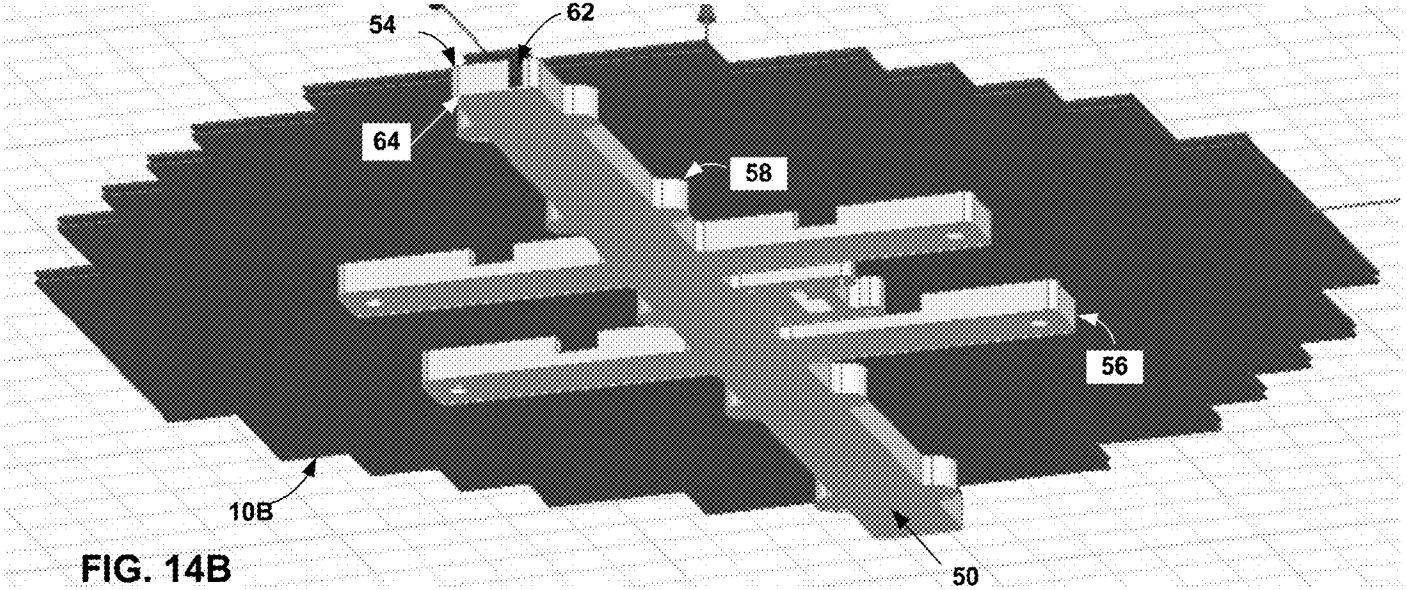
FIG. 14B is a diagram illustrating an assembly view of an example portion of a radar antenna including a radiated portion and a feed portion.

FIG. 14A is a diagram illustrating an isometric view of a coupling slot plane of the radiating portion of a radar antenna according to one or more techniques of this disclosure. FIG. 14A depicts coupling slot plane 32 with coupling slots 36 in outer plated layer 38.

FIG. 14B is a diagram illustrating an assembly view of an example portion of a radar antenna including a radiated portion and a feed portion. Feed portion 54 is configured to support radar antenna 10B as well as conduct RF energy to and from coupling slots 36 (not shown in FIG. 14B). Radar antenna 10B corresponds to radar antennae 10 and 10A described above in relation to FIGS. 1 and 2.

In the example of FIG. 14, feed portion 54 includes feed waveguide 50, which corresponds to feed waveguide 50 described above in relation to FIG. 13. Feed portion 54 may also include one or more support structures 56 and one or more positioning structures 58.

As described above in relation to FIG. 12, feed portion 54 may include one or more termination edges, such as termination edge 64. In some examples, termination edge 64 may completely enclose conducting path of feed waveguide 50. In other examples, as depicted in FIG. 14B, termination edge 64 may only partially enclose the end of the conducting path leaving an opening 62. The size of opening 62 may depend on the operating frequency of the antenna. In some examples, opening 62 in the conducting path left by a termination edge 64 that partially covers the end of the conducting path may be desirable to release humidity, condensed moisture or particles, such as dust, that may enter the conducting path of feed waveguide 50.

Support structures 56 may provide structural support to radar antenna 10B, which may be desirable for applications where radar antenna 10B may be subject to vibration or shock. For example, in applications where radar antenna 10B may be part of a radar system on a vehicle, such as an aircraft. The depiction of support structures 56 in FIG. 14B are just one example of possible support structures. Support structures 56, and other features of feed portion 54 may also be configured for compatibility with existing radar systems that use a metallic slot waveguide antenna. In other words, radar antenna 10B may be configured to replace an existing metallic slot waveguide antenna on an existing radar system with little or no modifications to the existing radar system.

Positioning structures 58 may be studs, or other features that may accurately position the feed portion 54 on radar antenna 10B. In some examples, positioning structures 58 may be configured to mate with via holes or other features of coupling slot plane 32 of radar antenna 10B.

Figure 15:
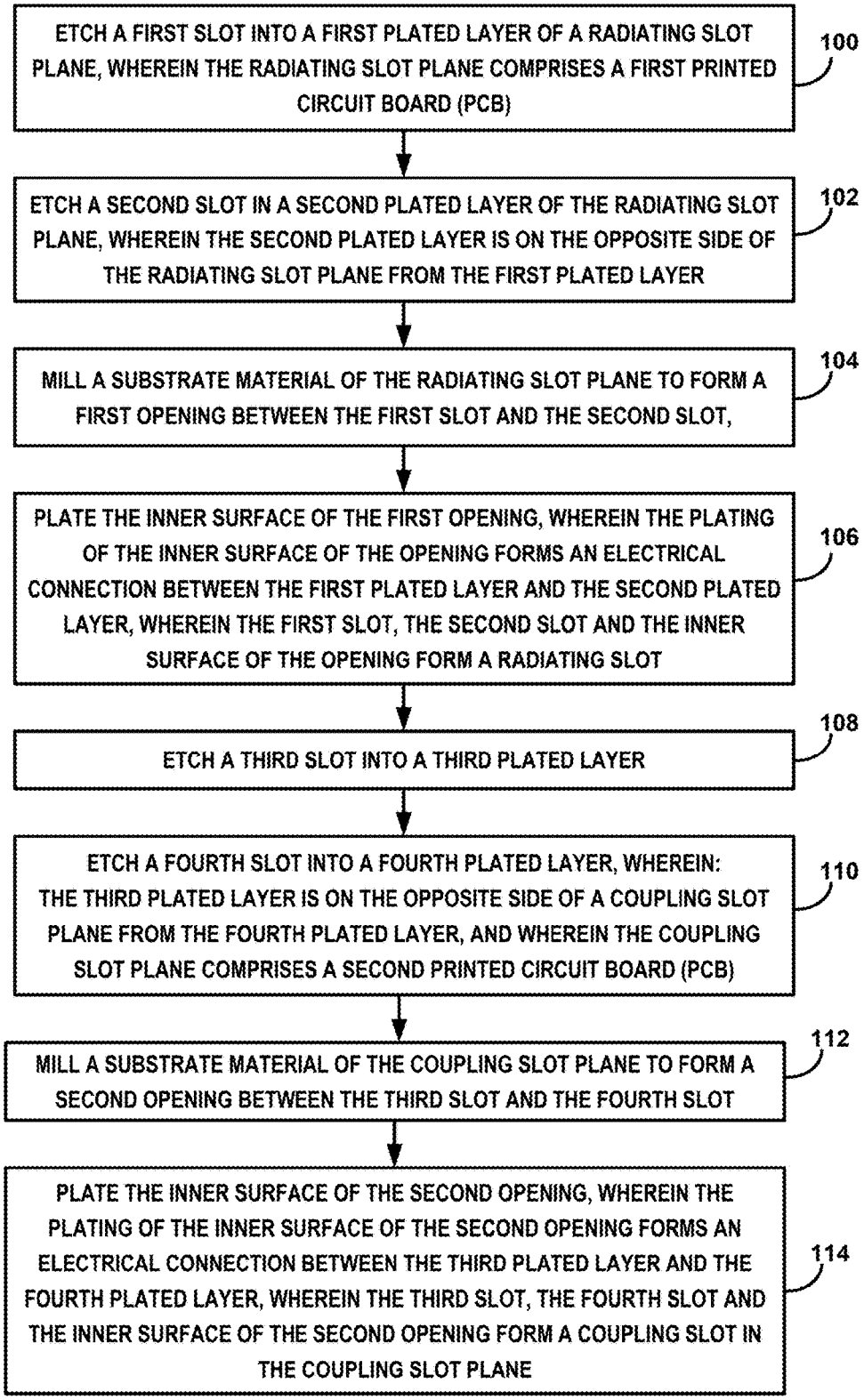
FIG. 15 is a flow chart illustrating an example process of forming a slot antenna in accordance with one or more techniques of this disclosure.

FIG. 15 is a flow chart illustrating an example process of forming a slot antenna in accordance with one or more techniques of this disclosure. FIG. 15 is just one example process for forming a radar antenna of this disclosure. In other examples, the steps listed may be performed in a different order, the process may include additional steps not listed or exclude some listed steps.

For clarity, the description of forming a slot antenna in relation to FIG. 15 may focus on forming a single feature, for example, a single coupling slot in the coupling slot plane. However, as described above in relation to FIG. 4, the coupling slot plane 32 includes a plurality of coupling slots 36. Similarly, the radiating slot plane 12, described above in relation to FIG. 3 includes a plurality of radiating slots 14 arranged in a plurality of slot rows 42. The steps of FIG. 15 may apply equally to the plurality of slots, through-holes and other features in a slot antenna of this disclosure. The steps of FIG. 15 will be described primarily in relation to the features of FIGS. 2 and 14, unless otherwise mentioned.

In radiating slot plane 12, etch a first slot 14C into the first or outer plated layer 16 of a clad PCB, such as a copper clad PCB (100) as shown in FIG. 5. The dimensions, such as length, width and shape, of slot 14 may depend on the operating frequency or other parameters of the radar antenna. Etching the slot 14C into outer plated layer 16 may leave behind substrate material of the PCB radiating slot plane 12, as depicted by substrate 20A in FIG. 5.

On the opposites side of radiating slot plane 12 etch a second slot in the second or inner plated layer 18 of radiating slot plane 12 (102). Etching the second slot into inner plated layer 18 may leave behind substrate material, similar to that depicted by substrate 20A in FIG. 5. The second slot may be etched at the same time as first slot 14C, or may be etched in two separate etching steps. The second slot may be configured to be directly opposite and have the same dimensions as slot 14C.

As shown in FIG. 6, mill substrate material 20A of the radiating slot plane 12 to form a first opening 14D through the substrate layer between the first slot and the second slot (104). As described above, laser milling may provide advantages over other techniques in retaining the accurate shape and dimensions of the PCB etching process in the interior surfaces of the opening between the first slot and the second slot. The opening, as defined by the interior surface, may have approximately the same shape and dimensions as the first slot and the second slot. As described above, accurate dimensions and placement for radar antennae may be desirable for radar performance, such as minimizing leakage, reducing sidelobes, and similar factors.

Form a radiating slot 14 by plating the interior surface of the first opening. Plating the interior surface 22 of the opening may form an electrical connection between the first plated layer 16 and the second plated layer 18 (106). In other words, the combined etched first slot 14C, the etched second slot and the milled and plated interior surface 22 of the opening form the radiating slot 14. The etching, milling and plating steps may be repeated for the plurality of radiating slots 14 in the plurality of slot rows 42. The plating material of interior surface 22 may be the same or different material than the material of plated outer plated layer 16 and inner plated layer 18. As one possible example, the material of outer plated layer 16 and inner plated layer 18 may be copper, or a copper alloy. The material of interior surface 22 may be the same copper alloy, or may be a different composition copper alloy, or some other compatible conductive material.

In a second, clad PCB, etch a third slot in this third PCB layer (108). The dimensions of the third slot may be the same or different dimensions as the radiating slot 14. The dimensions of the third slot may depend on the operating frequency or other parameters of the radar antenna. As described above, etching the third slot may leave behind substrate material, which may have similar structure and appearance to substrate 20A depicted by FIG. 5.

Similar to the second slot described above, etch a fourth slot in the opposite side of the second, clad PCB (110). The second PCB may be configured as the coupling slot plane 32. In other words, the third slot in the third PCB layer corresponds to the inner plated layer 28 of coupling slot plane 32. The fourth slot in the fourth PCB layer corresponds to an etched slot in the outer plated layer 38 of coupling slot plane 32.

Similar to the description above in relation to step 104, mill the substrate material of the coupling slot plane 32 to form a second opening between the third slot and the fourth slot (112). The second may appear similar to the first opening defined by the interior surfaces of the substrate between the etched slots as depicted in FIG. 6. The size and shape of the second opening may be approximately the same size and shape as the third slot and the fourth slot.

Similar to the description above in relation to step 106, form a coupling slot 36 in coupling slot plane 32 by plating the interior surface of the second opening (114). The plating of the interior surface of the second opening may form an electrical connection between the third plated layer, inner plated layer 28 and the fourth plated layer, outer plated layer 38. In other words, the third etched slot, the fourth etched slot and the interior surface of the second opening may form a coupling slot 36 in the coupling slot plane 32. As described above, the plating material of the interior surface of the second opening may be the same or different than the material for the inner plated layer 28 and outer plated layer 38. Also, the plating and substrate material of the radiating slot plane 12 may be the same or different as the plating and substrate material of the coupling slot plane 32.

Other steps, not shown in FIG. 15, may include bonding the walls 26 to the coupling slot plane 32 and radiating slot plane 12. In some examples wall material may be bonded to either coupling slot plane 32 or radiating slot plane 12 and removing material to form walls 26. In other examples, walls 26 may be formed and bonded to coupling slot plane 32 and radiating slot plane 12. Forming the walls 26 is described in more detail above in relation to FIGS. 8-11.

In some examples, through-holes 34 may be formed in walls 26. The interior surface 35 of through-holes 34, may be plated and form an electrical connection to one or more of outer plated layer 16, inner plated layer 18, inner plated layer 28 and outer plated layer 38. Plated through-holes 34 may act as walls of conducting paths 24 of the branches of radiating waveguides 11, similar to through-holes as used in SIW techniques. In other examples, the surfaces of walls 26 may be plated with conductive material and act as walls of radiating waveguides 11.

In some examples, a metallic coupling waveguide, which may be referred to as a pedestal, a driving waveguide or a feed waveguide 50 as depicted in FIGS. 13 and 14B, may be bonded to the radiating portion of the radar antenna. Feed waveguide 50, may be configured to transfer RF energy from the RF generating components of the radar system to each branch of the radiating waveguides 11 of the antenna as well as to transfer the received RF energy received by the radar antenna to the radar receiving electronics.

Various examples of the disclosure have been described. These and other examples are within the scope of the following claims.

The invention claimed is:

1. An antenna device, the device comprising:
- a radiating slot plane comprising:
  - a radiating slot array comprising a plurality of slots;
  - a printed circuit board (PCB) comprising a first plated layer, a second plated layer, and a substrate layer, wherein each slot of the radiating slot array includes an interior surface, wherein:
    - the interior surface of each slot extends from the first plated layer to the second plated layer through the substrate layer,
    - the interior surface of each slot comprises a conductive plated material, wherein the conductive plated material electrically connects the first plated layer to the second plated layer;
- a radiating waveguide comprising:
  - a radio frequency (RF) conducting path, wherein the RF conducting path of the radiating waveguide comprises a gas;
  - a third plated layer; and
  - the second plated layer, wherein:
    - the second plated layer and the third plated layer comprise a conductive material,
    - the second plated layer is electrically connected to the third plated layer and is electrically connected to the first plated layer of the radiating plane;
    - the third plated layer is electrically connected to the first plated layer of the radiating plane.

2. The device of claim 1, wherein the substrate layer of the radiating plane comprises a first substrate layer, the device further comprising:
- a coupling slot plane comprising:
  - a PCB including the third plated layer, a fourth plated layer, and a second substrate layer;
  - a plurality of coupling slots, wherein each coupling slot includes an interior surface, wherein:
    - the interior surface of the coupling slot extends from the third plated layer to the fourth plated layer through the second substrate layer,
    - the interior surface comprises a conductive plated material, wherein the conductive plated material electrically connects the third plated layer to the fourth plated layer.

3. The device of claim 2, further comprising a feed waveguide, wherein:
- the feed waveguide is configured to conduct RF energy to the plurality of coupling slots, and
- the feed waveguide is configured to provide structural support to the device.

4. The device of claim 1, wherein the radiating waveguide further comprises a first wall and a second wall, wherein the first wall and the second wall comprise a plurality of through-holes, wherein the through-holes include an interior surface, wherein:
- the interior surface of each through-hole extends from the first plated layer to the fourth plated layer through the first substrate layer and the second substrate layer, the interior surface is plated with a conductive material, and wherein the conductive material electrically connects the first plated layer to the fourth plated layer.

5. The device of claim 1, wherein the radiating waveguide further comprises a first wall and a second wall, wherein the first wall and the second wall comprise a plated surface, wherein the plated surface of the first wall and the plated surface of the second wall electrically connect the second plated layer to the third plated layer.

6. The device of claim 1, wherein the gas is air.

7. A method of forming a slot waveguide antenna, the method comprising:
- etching a first slot into a first plated layer of a radiating slot plane, wherein the radiating slot plane comprises a first printed circuit board (PCB);
- etching a second slot in a second plated layer of the radiating slot plane, wherein the second plated layer is on the opposite side of the radiating slot plane from the first plated layer;
- milling a substrate material of a first substrate layer of the radiating slot plane to form a first opening between the first slot and the second slot, wherein:
  - a size and shape of the first opening is defined by an interior surface of the first opening, and
  - the size and shape of the first opening is approximately a same size and shape as the first slot and the second slot;
- plating the interior surface of the first opening, wherein the plating of the interior surface of the opening forms an electrical connection between the first plated layer and the second plated layer, wherein the first slot, the second slot and the interior surface of the opening form a radiating slot;
- etching a third slot into a third plated layer;
- etching a fourth slot into a fourth plated layer, wherein:

the third plated layer is on the opposite side of a coupling slot plane from the fourth plated layer, and wherein the coupling slot plane comprises a second printed circuit board (PCB);

milling a substrate material of a second substrate layer of the coupling slot plane to form a second opening between the third slot and the fourth slot, wherein:

a size and shape of the second opening is defined by an interior surface of the second opening, and the size and shape of the second opening is approximately a same size and shape as the third slot and the fourth slot;

plating the interior surface of the second opening, wherein the plating of the interior surface of the second opening forms an electrical connection between the third plated layer and the fourth plated layer, wherein the third slot, the fourth slot and the interior surface of the second opening form a coupling slot in the coupling slot plane.

8. The method of claim 7, further comprising:

bonding the second plated layer of the radiating slot plane to a first wall and to a second wall;

bonding the third layer of the coupling slot plane to the first wall and the second wall, wherein:

the first wall, the second wall, the second plated layer and the third plated layer form a radiating waveguide comprising a radio frequency (RF) conducting path, and the RF conducting path comprises a gas.

9. The method of claim 8, wherein the first wall and the second wall comprise a plurality of through-holes, wherein the through-holes include an interior surface, wherein:

the interior surface of each through-hole extends from the first plated layer to the fourth plated layer through the first substrate layer of the radiating slot plane and the second substrate layer of the coupling slot plane, the interior surface is plated with a conductive material, and wherein the conductive material electrically connects the first plated layer to the fourth plated layer.

10. The method of claim 8, wherein the first wall and the second wall, comprise a plated surface, wherein the plated surface of the first wall and the plated surface of the second wall electrically connect the second plated layer to the third plated layer.

11. The method of claim 7, wherein the radiating slot in the radiating slot plane is a first radiating slot of a plurality of radiating slots, wherein:

the plurality of radiating slots is arranged in a plurality of radiating slot rows, each respective radiating slot row of the plurality of radiating slot rows comprises a plurality of radiating slots.

12. The method of claim 7, wherein the coupling slot is a first coupling slot of a plurality of coupling slots and wherein the plurality of coupling slots is configured to: conduct transmitted RF energy between a feed waveguide the radiating slot plane; and conduct received RF energy collected by the radiating slot plane to the feed waveguide.

13. The method of claim 12, wherein the feed waveguide provides structural support to the radiating slot plane.

* * * * *